US010221664B2

(12) United States Patent
Farshori et al.

(10) Patent No.: US 10,221,664 B2
(45) Date of Patent: Mar. 5, 2019

(54) METHOD AND SYSTEM FOR OPTIMIZING WELL PRODUCTION

(71) Applicant: FLUIDSTREAM ENERGY INC., Calgary (CA)

(72) Inventors: Farhan Farshori, Calgary (CA); Marcel Obrejanu, Calgary (CA)

(73) Assignee: Fluidstream Energy Inc., Calgary (CA)

( * ) Notice: Subject to any disclaimer, the term of this patent is extended or adjusted under 35 U.S.C. 154(b) by 860 days.

(21) Appl. No.: 14/634,442

(22) Filed: Feb. 27, 2015

(65) Prior Publication Data

US 2016/0251946 A1 Sep. 1, 2016

(51) Int. Cl.

| | |
|---|---|
| ***E21B 43/12*** | (2006.01) |
| ***E21B 47/06*** | (2012.01) |
| ***E21B 47/04*** | (2012.01) |
| ***E21B 21/08*** | (2006.01) |
| ***E21B 44/04*** | (2006.01) |
| ***E21B 41/00*** | (2006.01) |
| ***E21B 44/06*** | (2006.01) |

(52) U.S. Cl.

CPC ..... *E21B 43/129* (2013.01); *E21B 21/08* (2013.01); *E21B 41/0092* (2013.01); *E21B 44/04* (2013.01); *E21B 44/06* (2013.01); *E21B 47/04* (2013.01); *E21B 47/06* (2013.01)

(58) Field of Classification Search

CPC ..... E21B 47/06; E21B 47/04; E21B 41/0092; E21B 21/08; E21B 44/06; E21B 44/04

See application file for complete search history.

(56) References Cited

U.S. PATENT DOCUMENTS

| | | | | |
|---|---|---|---|---|
| 5,605,193 | A * | 2/1997 | Bearden | E21B 41/0057 166/105.6 |
| 2010/0038078 | A1* | 2/2010 | Fink | E21B 43/121 166/250.15 |
| 2011/0308812 | A1* | 12/2011 | Bullen | E21B 43/121 166/372 |
| 2013/0192841 | A1* | 8/2013 | Feasey | E21B 21/08 166/336 |
| 2017/0037691 | A1* | 2/2017 | Savage | E21B 21/08 |

* cited by examiner

*Primary Examiner* — Giovanna C. Wright
*Assistant Examiner* — Tara E Schimpf
(74) *Attorney, Agent, or Firm* — Christensen O'Connor Johnson Kindness, PLLC

(57) ABSTRACT

A method and system for controlling production from a hydrocarbon well that produces liquid and gas phases using well production equipment. A hydraulic power source supplies a flow of hydraulic fluid to a manifold. The manifold distributes the hydraulic fluid to each of the downhole pump and the casing gas pump. A controller is used to optimize production from the hydrocarbon well by controlling the hydraulic power source and the speeds of the downhole pump and the casing gas pump. The controller controls these components based on readings from a casing gas pressure sensor and a liquid level sensor relative to a predetermined casing gas pressure and a predetermined liquid level.

8 Claims, 2 Drawing Sheets

METHOD AND SYSTEM FOR OPTIMIZING WELL PRODUCTION

TECHNICAL FIELD

This relates to a method and system for optimizing well production, and in particular, by optimizing well production by distributing power from a hydraulic power source.

BACKGROUND

A hydrocarbon well generally produces a liquid phase and a gaseous phase, which may include liquid hydrocarbons, gaseous hydrocarbons, water, and sand. In one common arrangement, fluids are produced from the well using a downhole pump to pump the liquid phase and a casing gas pump or compressor to pump the gas phase from the well casing. It will be understood that these are generalized purposes, as the liquid phase may comprise sand and some entrained gas, while the casing gas pump may comprise some liquid or vapour that condenses to liquid and some sand or solids as well and the pumps are designed accordingly.

SUMMARY

According to an aspect, there is provided a system for controlling production from a hydrocarbon well that produces liquid and gas phases using well production equipment, the hydrocarbon well having a downhole liquid level and a casing gas pressure, the production equipment comprising a hydraulically powered downhole pump that primarily pumps the liquid phase from the hydrocarbon well and a hydraulically driven casing gas pump that primarily pumps the gas phase from the hydrocarbon well, the system comprising a hydraulic power source that supplies a flow of hydraulic fluid to a manifold, the manifold distributing the hydraulic fluid to each of the downhole pump and the casing gas pump, the hydraulic power source producing a variable hydraulic power level and having a maximum power rating, a casing gas sensor that senses the casing gas pressure in the hydrocarbon well, a liquid level sensor that senses the liquid level in the hydrocarbon well, a controller that is programmed to optimize production from the hydrocarbon well by comparing readings from the casing gas pressure sensor to a predetermined casing gas pressure, comparing readings from the liquid level sensor to a predetermined liquid level, and controlling the hydraulic power level of the hydraulic power source, and controlling the speeds of the downhole pump and the casing gas pump by controlling the flow of hydraulic fluid from the manifold to each of the downhole pump and the casing gas pump.

According to another aspect, the controller may be programmed to increase the flow of hydraulic fluid to the downhole pump when the liquid level is above the predetermined liquid level, decrease the flow of hydraulic fluid to the downhole pump when the liquid level is below the predetermined liquid level, increase the flow of hydraulic fluid to the casing gas pump when the casing gas pressure is above the predetermined casing gas pressure, and decrease the flow of hydraulic fluid to the casing gas pump when the casing gas pressure is below the predetermined gas pressure.

According to another aspect, should the required speeds of the downhole pump and the casing gas pump exceed maximum power rating of the hydraulic power source, the controller may be programmed to control the relative flow to each of the downhole pump and the casing gas pump to optimize production from the hydrocarbon well at speeds less than the required speeds.

According to another aspect, the downhole pump may be a reciprocating pump having a reduced or negative power requirement on the downstroke of the reciprocating pump.

According to another aspect, the downhole pump may be a rotary pump.

According to another aspect, the manifold may circulate hydraulic fluid through a heat trace circuit.

According to another aspect, the controller may be further programmed to control the hydraulic power level and the speeds based on readings from one or more of a temperature sensor for sensing the temperature of an output flow from the casing gas pump, input and output compressor pressure sensors on the suction and discharge ports for determining a compression ratio of the casing gas pump, a suction pressure sensor for sensing the suction pressure of an input flow to the casing gas pump, and a production flow sensor for sensing the production flow rate from the downhole pump.

According to an aspect, there is provided a method of controlling production from a hydrocarbon well that produces liquid and gas phases using well production equipment, the hydrocarbon well having a downhole liquid level and a casing gas pressure, the production equipment comprising a hydraulically powered downhole pump that primarily pumps the liquid phase from the hydrocarbon well and a hydraulically driven casing gas pump that primarily pumps the gas phase from the hydrocarbon well, the method comprising connecting a hydraulic power source to supply a flow of hydraulic fluid to a manifold, the hydraulic power having a maximum power rating, connecting the manifold to distribute the hydraulic fluid to each of the downhole pump and the casing gas pump, sensing the casing gas pressure in the hydrocarbon well and the liquid level in the hydrocarbon well, using a programmable controller, optimizing production from the hydrocarbon well by comparing readings from the casing gas sensor to a predetermined casing gas pressure, comparing readings from the liquid level sensor to a predetermined liquid level, and controlling the hydraulic power level of the hydraulic power source, and controlling the speeds of the downhole pump and the casing gas pump by controlling the flow of hydraulic fluid from the manifold to each of the downhole pump and the casing gas pump.

According to another aspect, optimizing production may further comprise the steps of increasing the flow of hydraulic fluid to the downhole pump when the liquid level is above the predetermined liquid level, decreasing the flow of hydraulic fluid to the downhole pump when the liquid level is below the predetermined liquid level, increasing the flow of hydraulic fluid to the casing gas pump when the casing gas pressure is above the predetermined casing gas pressure, and decreasing the flow of hydraulic fluid to the casing gas pump when the casing gas pressure is below the predetermined gas pressure.

According to another aspect, optimizing production may further comprise the steps of controlling the hydraulic power level and the speeds by sensing one or more of a temperature of an output flow from the casing gas pump, a compression ratio of the casing gas pump, a suction pressure of an input flow to the casing gas pump, and a production flow rate from the downhole pump.

According to another aspect, should the required speeds of the downhole pump and the casing gas pump exceed maximum power rating of the hydraulic power source, the controller may be programmed to control the relative flow to each of the downhole pump and the casing gas pump to optimize production from the hydrocarbon well.

According to another aspect, the downhole pump may be a reciprocating pump and may comprise a generator that generates hydraulic power on the downstroke of the reciprocating pump, the generator being connected to the manifold.

According to another aspect, the downhole pump may be a rotary pump.

According to another aspect, the manifold may circulate hydraulic fluid through a heat trace circuit.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
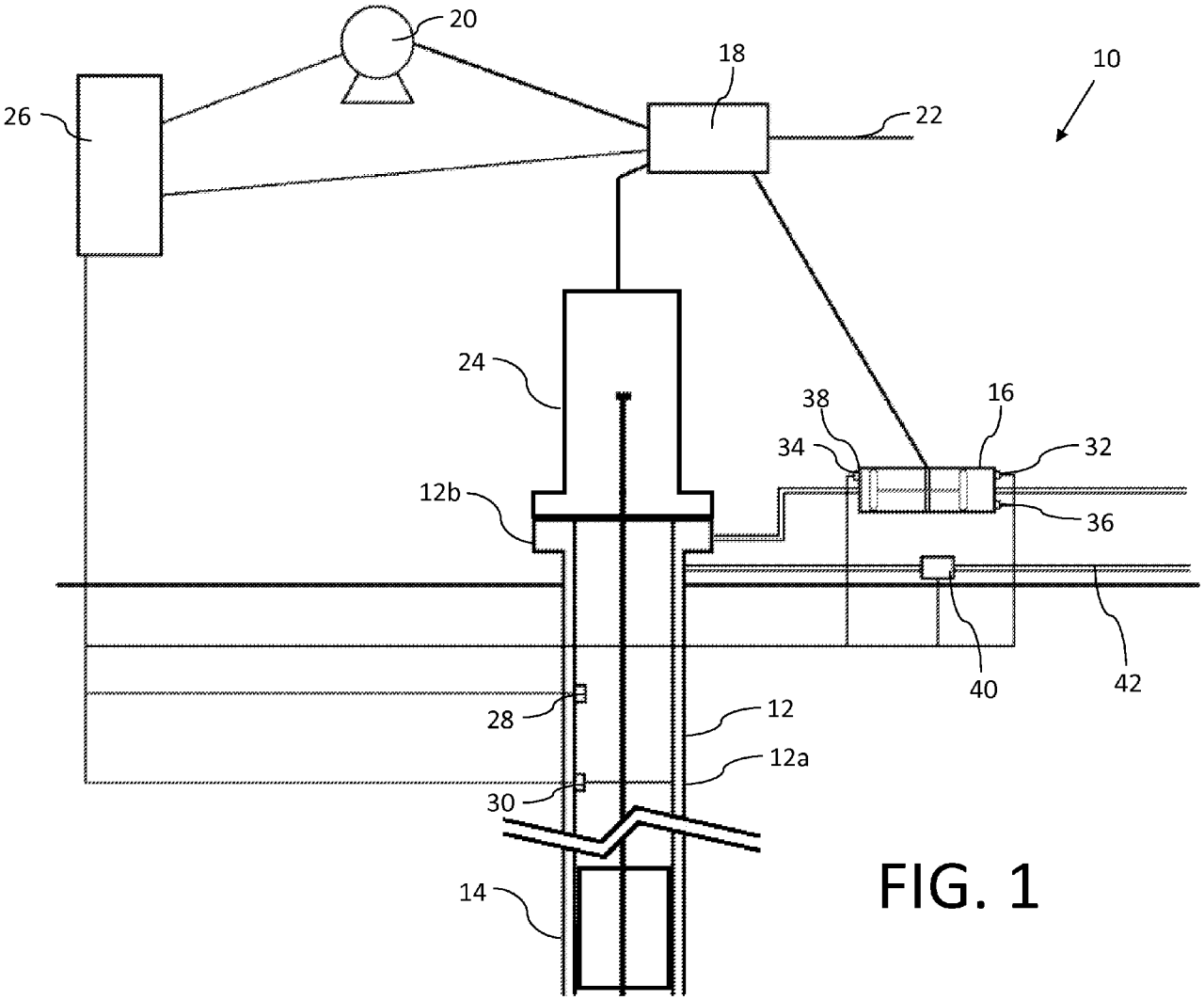
FIG. 1 is a schematic view of a system for controlling production from a hydrocarbon well.

A system for controlling production from a hydrocarbon well, generally identified by reference numeral 10, will now be described with reference to FIGS. 1 and 2.

Referring to FIG. 1, there is shown a system for controlling production from a hydrocarbon well 12. Hydrocarbon well 12 has a casing 12*a* and a wellhead 12*b* and produces liquid and gas phases using well production equipment such as a downhole pump 14 and a casing gas pump 16, which may also be referred to as a casing gas compressor. Each of pumps 14 and 16 are hydraulically powered.

Hydrocarbon well 12 will generally have a casing with perforations or openings toward the bottom that allow fluids to enter the well from an adjacent formation that contains hydrocarbons. Well 12 will have a liquid level due to the liquid phase that flows in from the formation, as well as a casing gas pressure due to the gas phase that enters the well and the back pressure from the gas flow line on surface.

It will be understood that the gas phase may include lighter hydrocarbons such as methane that will generally always be a gas at the pressures and temperatures encountered in a well, but may also include heavier hydrocarbons that may exist in a gas phase or a liquid phase and that may condense or convert to a vapour, depending on the pressures, temperatures, and compositions that are encountered. Furthermore, one phase may be entrained in another phase (e.g. gas in liquid or liquid in gas), or a change in conditions may cause a slug of gas or liquid to pass through the other type of pump, as the case may be. As a result, the pumps 14 and 16 may end up pumping both liquid and gas. In addition, there may be solids, such as sand, that will also pass through pump 14 and 16. As used herein, the downhole pump 14 is discussed as handling the liquid phase and the casing gas pump 16 is discussed as handling the gas phase. However, it will be understood that in operation, other phases may be present and that the pumps that will be used are designed to either minimize this, or to handle the presence of other phases.

Pumps 14 and 16 are connected to a manifold 18 that receives hydraulic power from a hydraulic power source 20. Hydraulic power source 20 supplies a flow of hydraulic fluid to manifold 18, which then distributes the hydraulic fluid to each of downhole pump 14 and casing gas pump 16. As is common in the industry, hydraulic power source 20 may be made up of a motor that powers a hydraulic pump. Hydraulic power source 20 is capable of producing a variable hydraulic power level and will generally have a maximum power rating. In one example, the motor that powers the hydraulic pump in hydraulic power source 20 may be set operate at a constant RPM and drives a variable flow hydraulic pump. The load of the motor will change depending on the requirements of the hydraulic pump, which will in turn depend on the pressure of the hydraulic fluid and the rate of flow. The motor will have a maximum load at which it can be driven, which corresponds to the maximum power rating of the hydraulic power source generally. In other examples, hydraulic power source 20 may be a hydraulic pump that is powered by a variable speed motor or a multi-stage motor, such as a two-stage or three-stage motor.

Downhole pump 14 may be any type of pump that is capable of being driven hydraulically to produce fluids in a well as are well known in the industry. Some examples include reciprocating or rod pumps, rotary pumps, pumps with drives on surface, and pumps with downhole drives. As shown in FIG. 1, downhole pump 14 is a reciprocating pump that is operated by a surface pump drive 24.

In addition to pumps 14 and 16, manifold 18 may be connected to other equipment, such as a heat trace system 22, and may be connected to receive hydraulic power from another source. For example, if pump 14 is a reciprocating pump, pump 14 may generate hydraulic pressure on its downstroke, which can then be used by controller 26. Heat trace system 22 may use hydraulic fluid or may use a separate coolant to transfer heat from wellhead equipment that produce heat, such as hydraulic power source 20, to components that are subject to freezing, such as wellhead 12*b*. If a separate coolant is used, manifold 18 will provide power to a pump (not shown) that will circulate coolant. Otherwise, manifold 18 may directly circulate hydraulic fluid though heat trace 22.

Manifold 18 is designed to control the distribution of flow from hydraulic power source 20 to the various components based on the required need, as will be discussed below in more detail. Manifold 18 is controlled by a controller 26, such as a PLC controller or other computer processing equipment, that controls system 10 based on inputs received from various sensors and based on target operating conditions that may be predetermined by the user and varied as required. In particular, the sensors may include a casing gas pressure sensor 28 that senses the casing gas pressure in hydrocarbon well 12; a liquid level sensor 30 that senses the liquid level in hydrocarbon well 12; a temperature sensor 32 that senses the temperature of an output flow from casing gas pump 16; input and output compressor pressure sensors 34 and 36 that measure the pressure of gas as it enters and leaves casing gas pump 16 in order to calculate a compression ratio of casing gas pump 16; a suction pressure sensor 38 (which may be the same as pressure sensor 34) for sensing the suction pressure of an input flow to casing gas pump 16; an ambient temperature sensor for sending ambient temperatures (not shown); and a production flow sensor 40 for sensing the production flow rate from downhole pump in production line 42. It will be understood that the sensors mentioned above are intended to be described in terms of their function and not their structure and that a person of ordinary skill may use known sensors in different sensor arrangements to measure the same variables discussed above, or to allow controller 26 to calculate certain variables based on readings from one or more other sensors. For example, there are many sensors that can be used to determine or estimate a liquid level, such as by measuring the rod load pressure, using fluid shots, monitoring motor load, etc. As these sensors measure variables that are commonly or easily measured in the art, it is unnecessary to describe the structure of the particular sensors and the manner in which they are employed in more detail.

Figure 2:
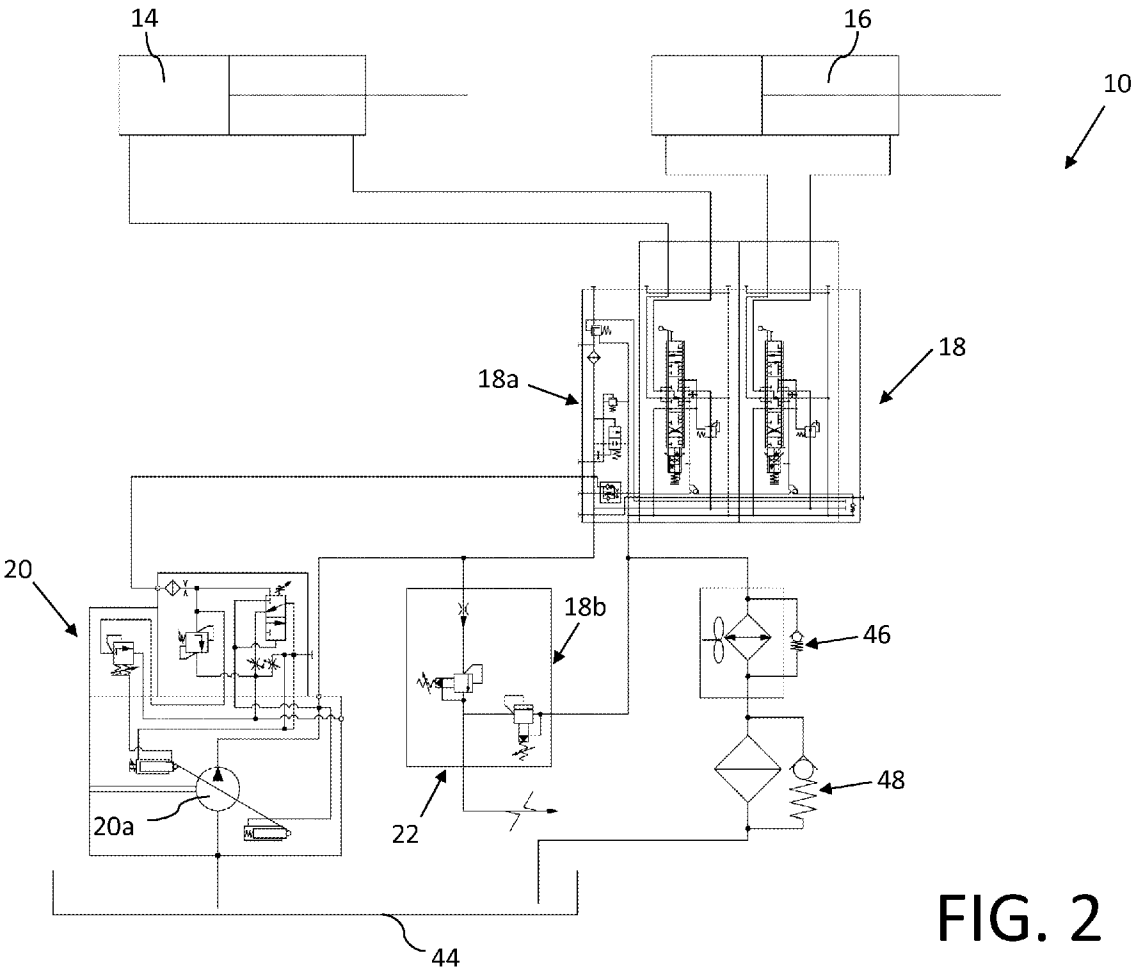
FIG. 2 is a schematic view of hydraulic controls for a system shown in FIG. 1.

Referring to FIG. 2, an example of a hydraulic system that may be used is shown. Hydraulic power source 20 includes a pump 20*a* that is driven to draw hydraulic fluid from a fluid reservoir 44 and pump the fluid to be distributed by manifold 18. As shown, manifold 18 has a first portion 18*a* that controls the distribution and flow of hydraulic fluid to pumps 14 and 16, and a second portion 18*b* that may be considered a heat generating manifold and controls the flow of fluid through a heat trace system 22. Heat trace system 22 may include flow paths that allow the hydraulic fluid to be heated by various heat generating equipment on site, such as internal combustion motors, compressors, etc. and circulates the heat to equipment that requires protection from the cold. As shown, manifold 18 and hydraulic power source 20 have various valves and switches (not labelled) that controller 26 (shown in FIG. 1) uses to control the flow of hydraulic fluid through system 10. Prior to being returned to fluid reservoir 44, hydraulic fluid is preferably passed through an oil cooler 46 to return hydraulic fluid to a preferred temperature range and through a filter 48 to remove any contaminants.

The operation of controller 26 will now be described. In a broad description, controller 26 is programmed to optimize production from the hydrocarbon well by comparing readings from casing gas pressure sensor 28 to a predetermined casing gas pressure and reading from liquid level sensor to a predetermined liquid level. Based on these readings, the distribution of hydraulic power through manifold 18 to downhole pump 14 and casing gas pump 16 as well as the speed will be controlled, such as to reach the predetermined or optimal readings. In addition to controlling the speeds of pumps 14 and 16, controller 26 also monitors and controls level of the hydraulic power source, and controlling the speeds of the downhole pump and the casing gas pump by controlling the flow of hydraulic fluid from the manifold to each of the downhole pump and the casing gas pump. Generally speaking downhole pump 14 will be set to operate at a minimum speed in order to maintain production flow and prevent having to prime the system. Controller 26 may also maintain data on the operation of pumps 14 and 16, production rates, sensor data, etc., which may be used to monitor and characterize well 12 and may be used in making decisions about power allocation. For example, while the predetermined liquid level and casing gas pressures may be user defined, they may also be the result of calculations made by controller 26 to optimize production rate. It will be understood that "optimal" or "optimize" may not refer to the greatest or highest possible flow rate and may take into account power efficiency, future production rates, maintaining the integrity of the hydrocarbon formation, preventing the introduction of sand into the well, etc.

In most circumstances, controller 26 will be programmed to increase or decrease the flow of hydraulic fluid to downhole pump 14 when the liquid level is above or below the predetermined liquid level, respectively, and to increase or decrease the flow of hydraulic fluid to casing gas pump 16 when the casing gas pressure is above or below the predetermined casing gas pressure, respectively. Controller 26 may also be programmed to slow down or accelerate pump 14 or 16 as the desired liquid level or pressure is being approached to prevent overshooting the level or pressure in either direction. These types of instructions may be made and adjusted based on experience and observations. It will be understood that pump speed may relate to the amount of fluid provided as well as switching rates.

In some circumstances, the speeds required of downhole pump 14 and casing gas pump 16 in order to reach the predetermined values may exceed that maximum power rating available from hydraulic power source 20. In this case, controller 26 may be programmed to control the relative flow to each of downhole pump 14 and casing gas pump 16 to optimize production from the hydrocarbon well at a higher liquid level or higher pressure than would be preferred. In this circumstance, controller 26 may target a reduced speed for both pumps 14 and 16. Alternatively, controller 26 may reduce power to other components, such as heat trace system 22, depending on the safe operating requirements and the ambient temperature. In some embodiments, when power source 20 is operating at the maximum power rating, controller 26 may be programmed to adjust the speeds of downhole pump 14 and casing gas pump 16 while monitoring the production flow rate to determine an optimal operating condition within the imposed power constraint. For example, depending on well conditions, a better production flow rate may be achieved by allowing a higher liquid level or by allowing a higher casing gas pressure.

By providing a single power source instead of a separate power source for each piece of equipment, the amount of equipment may be reduced and the overall power requirements for the equipment may also be reduced. For example, a certain excess of power capacity is generally required for each power source, whereas the amount of excess power capacity overall on a well site may be reduced by using a single power source.

In other embodiments, the controller may be programmed to control system 10 based on one or more readings, in combination with those discussed above or on their own. In particular, the speed of casing gas pump 16 may be adjusted based on readings from temperature sensor 32 for sensing the temperature of an output flow from casing gas pump 16 to ensure pump 16 does not overheat. In addition, readings from input and output compressor pressure sensors 34 and 36 may be used to determine the compression ratio of the casing gas pump in order to determine whether pump 16 is operating at an optimal compression ratio or whether increasing or decreasing the speed of pump 16 would result in additional efficiencies. Readings from suction pressure sensor 38 for sensing the suction pressure of an input flow to casing gas pump 16 may also be used to determine whether pump 16 is operating in an efficient state. For example, gas pump 16 may be accelerated in a first part of its stroke in order to achieve a higher suction pressure, and may be slowed later as the pressure builds within casing gas pump 16 and more power is required.

In one example of system 10, the logic in controller 26 used to control downhole pump 14 may be based on one or more of the following: the hydraulic oil pressure related to downhole pump, where an increase or decrease in hydraulic pressure is related to load on the downhole pump; actual well fluid level; user-defined fluid level; load on downhole pump 14 such as the pump rod load if downhole pump 14 is a downhole rod pump or other loads if pump 14 is a positive displacement pump, progressive cavity pump, or a pump jack; production flow rate from well, including oil and any other liquids entrained in the oil, such as water and/or condensate.

In one example of system 10, the logic in controller 26 used to control casing gas pump 16 may be based on one or more of the following: a user defined target casing gas pressure or a calculated target casing gas pressure as the target pressure to be achieved by fluid pump; the optimal speed of the fluid pump as the speed needed to achieve the predetermined casing pressure; the actual speed of pump 16, which may be increased or decreased to achieve and maintain the target casing pressure in conjunction with other parameters/variables; discharge gas temperature, where casing gas pump 16 may be slowed or stopped to prevent overheating, and/or the compression ratio may be reduced; discharge pressure from pump 16; the maximum compression ratio for a given pump 16; the measured compression ratio; and instantaneous suction pressure.

The maximum compression ratio will generally determined by the equipment provider based on the type or model of pump and the environment in which it is being used. The ratio will be based on the risk of overheating. In the event of overheating, or a risk of overheating, the target suction pressure may be dynamically adjusted, the speed of the pump may be adjusted, or the compression ratio may be adjusted. These factors are generally related, and the manner in which they are adjusted may depend on the type of pump 16 being used.

In one example of system 10, the logic in controller 26 used to control hydraulic power supply 20 and manifold 18 may be based on one or more of the following: motor load allocated to the various driven equipment; the maximum available motor load; available motor load capacity; equipment requirements for reaching optimal conditions; and the cycles of equipment requirements. For example, there may be times where at a certain cycle in downhole pump 14 does not require as much motor load or where downhole pump 14 may generate power (such as on the downstroke of a reciprocating pump) or when casing gas pump 16 does not require as much motor load. When this occurs, controller 26 may use the excess motor load elsewhere if required.

An example of the logic that may be followed by controller 14 is as follows:

1. The user sets a minimum speed for the downhole pump, a desired liquid level and a desired casing gas pressure;
2. Downhole pump 14 is started at the minimum speed;
3. Casing gas pump 16 starts and controller 14 increases or decreases its speed to achieve the desired casing pressure;
4. If the desired casing pressure is achieved and the maximum motor load has not been reached, controller 14 starts optimizing downhole pump 14;
5. If motor load reaches the maximum limit before optimal downhole pump speed is achieved, controller 14 begins slowing casing gas pump 16, down hole pump 14 or both to allow for more motor load and find an optimal distribution of load to optimize system 10 within the power limit of hydraulic power source 20.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A method of controlling production from a hydrocarbon well that produces liquid and gas phases using well production equipment, the hydrocarbon well having a downhole liquid level and a casing gas pressure, the production equipment comprising a hydraulically powered downhole pump that primarily pumps the liquid phase from the hydrocarbon well and a hydraulically driven casing gas pump that primarily pumps the gas phase from the hydrocarbon well, the method comprising:

connecting a hydraulic power source to supply a flow of hydraulic fluid to a manifold, the hydraulic power source having a maximum power rating;

connecting the manifold to distribute the hydraulic fluid to each of the downhole pump and the casing gas pump;

sensing the casing gas pressure in the hydrocarbon well and the downhole liquid level in the hydrocarbon well; and using a programmable controller, optimizing production from the hydrocarbon well by:

comparing readings from a casing gas pressure sensor to a predetermined casing gas pressure;

comparing readings from a liquid level sensor to a predetermined liquid level;

controlling the hydraulic power level of the hydraulic power source; and controlling a speed of the downhole pump and a speed of the casing gas pump by controlling the flow of hydraulic fluid from the manifold to each of the downhole pump and the casing gas pump.

2. The method of claim 1, wherein controlling production further comprises the steps of:

increasing the flow of hydraulic fluid to the downhole pump when the liquid level is above the predetermined liquid level;

decreasing the flow of hydraulic fluid to the downhole pump when the liquid level is below the predetermined liquid level;

increasing the flow of hydraulic fluid to the casing gas pump when the casing gas pressure is above the predetermined casing gas pressure; and decreasing the flow of hydraulic fluid to the casing gas pump when the casing gas pressure is below the predetermined gas pressure.

3. The method of claim 2, wherein controlling production further comprises the steps of controlling the hydraulic power level and the speeds by sensing a temperature of an output flow from the casing gas pump, a compression ratio of the casing gas pump, a suction pressure of an input flow to the casing gas pump, a production flow rate from the downhole pump, or combinations thereof.

4. The method of claim 1, further comprising the step of comparing the speeds of the downhole pump and the casing gas pump to the maximum power rating of the hydraulic power source, and controlling the relative flow to each of the downhole pump and the casing gas pump to optimize production from the hydrocarbon well at speeds less than the required speeds.

5. The method of claim 1, wherein the downhole pump is a reciprocating pump having a reduced or negative power requirement on the downstroke of the reciprocating pump.

6. The method of claim 1, wherein the downhole pump is a rotary pump.

7. The method of claim 1, wherein the manifold circulates hydraulic fluid through a heat trace circuit.

8. The method of claim 1, wherein the liquid phase is produced through a production string and the gas phase is produced from between a casing string and the production string.

* * * * *